United States Patent [19]

Keeton

[11] 3,984,886

[45] Oct. 12, 1976

[54] FLUID-FILLED CUSHIONING ASSEMBLIES

[76] Inventor: J. Herbert Keeton, P.O. Box 278, Campbellsville, Ky. 42718

[22] Filed: Aug. 20, 1975

[21] Appl. No.: 606,079

[52] U.S. Cl. ..... 5/368; 297/284

[51] Int. Cl.[2] ..... A47C 27/08

[58] Field of Search ..... 5/365, 368, 369; 297/284, 452, 456; 215/358; 206/522; 220/20.5

[56] References Cited

UNITED STATES PATENTS

| | | | |
|---|---|---|---|
| 945,234 | 1/1910 | Hinsdale | 5/369 |
| 2,318,115 | 5/1943 | Tubbs | 137/233 X |
| 3,330,598 | 7/1967 | Whiteside | 297/456 |
| 3,363,941 | 1/1968 | Wierwille | 5/369 |
| 3,867,732 | 2/1975 | Morrell | 297/284 |

FOREIGN PATENTS OR APPLICATIONS

| | | | |
|---|---|---|---|
| 1,912,194 | 9/1970 | Germany | 5/369 |

*Primary Examiner*—Paul R. Gilliam
*Assistant Examiner*—Andrew M. Calvert
*Attorney, Agent, or Firm*—Cushman, Darby & Cushman

[57] ABSTRACT

Fluid-filled cushioning assemblies including a body member having a plurality of fluid-tight, fluid-filled cells formed therein. The cells may be sealed off from each other so that no fluid communication therebetween is possible, whereby the assembly will maintain the position in which it is disposed, each cell having a particular pressure therein, or free fluid communication between the cells may be provided so that the assembly may be worked into a particular position. A single valve may be provided for selectively sealing off the cells from one another or allowing fluid communication therebetween.

5 Claims, 4 Drawing Figures

FLUID-FILLED CUSHIONING ASSEMBLIES

BACKGROUND AND SUMMARY OF THE INVENTION

The invention relates in general to cushioning assemblies for use as car seats, couches, mattresses, cushions, and the like, and in particular to cushioning assemblies having a plurality of fluid-filled cells therein and means for selectively sealing off the cells from one another so that no free flow of fluid therebetween is possible, or for allowing free communication between the cells so that free flow of fluid therebetween takes place.

There are a number of prior art proposals for pneumatic cushioning assemblies, such as shown in U.S. Pat. Nos. 2,691,179, 3,110,520, 3,128,125, 3,296,635, and 3,363,941. Such prior art cushioning assemblies generally take one of two forms — those wherein free flow of fluid is provided between various cells formed within the cushioning assembly so that the assembly conforms to whatever shape object or body part is put into contact therewith, and those wherein fluid may be added to and subtracted from various portions of the assembly to provide a desired shape of the cushioning assembly to support a given body part, etc. An example of the latter type of assembly is disclosed in U.S. Pat. No. 3,363,941, wherein a plurality of fluid-containing segregated cells are provided, and a valve and compressed air source associated with each cell for selectively inflating the cell when support by that cell is desired, or deflating the cell when no support or reduced support by that cell is desired. While such a device can provide support for various portions of the user's body, a relatively complicated structure is provided, a plurality of valve and sealing means being necessary, as well as an outside pressure source.

According to the present invention, a cushioning assembly is provided that may have the shape thereof changed to conform to whatever portion of a user's body it is desired to support, such as the arch of a user's back. This is accomplished without the necessity for a plurality of valve means, of for an outside pressure source, a simple assembly being provided. This is accomplished according to the present invention by providing a plurality of fluid-filled fluid-tight cells within a body portion formed of deformable resilient material, and by providing means for selectively sealing off the cells from one another so that no free flow of fluid therebetween is possible or for allowing free communication between the cells so that free flow of fluid therebetween takes place. One valve means may accomplish this, the valve means in one position thereof allowing free flow of fluid between the cells so that the cushioning assembly may be shaped to conform to a wide variety of shapes to fulfill a wide variety of intended uses, and in a second position thereof locking the fluid within the cells so that the cushioning assembly will maintain the shape to which it has been conformed during use threof. No outside source of fluid pressure is necessary, the unit being self-contained.

It is the primary object of the present invention to provide a cushioning assembly that is simple yet may be readily shaped to provide support for various body parts during use thereof. This and other objects of the invention will become clear from an inspection of the detailed description of the invention, and from the appended claims.

DETAILED DESCRIPTION OF THE INVENTION

Figure 1:
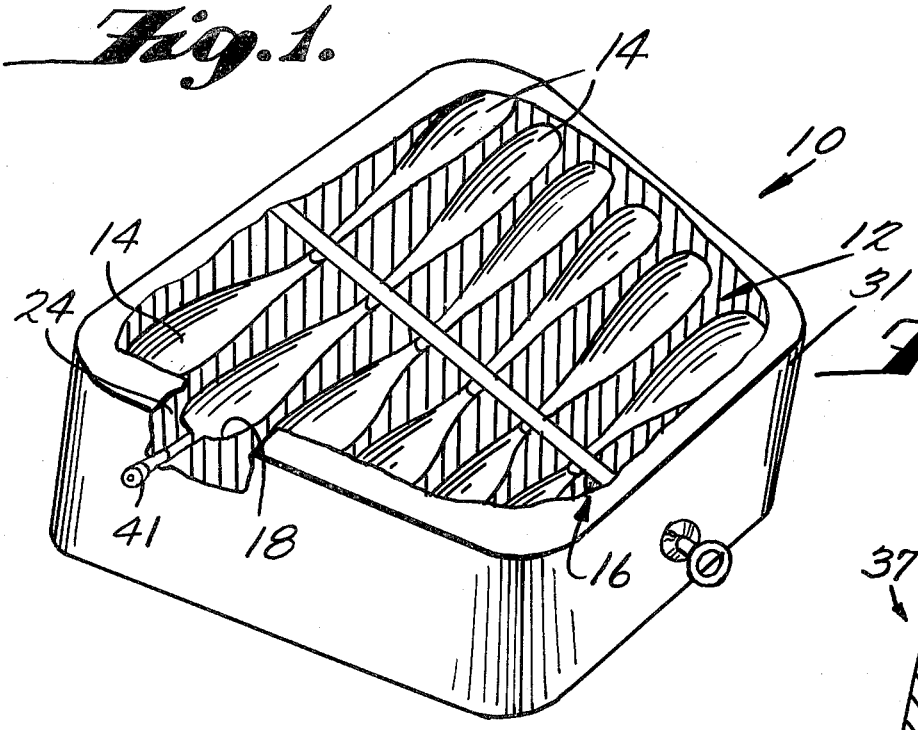
FIG. 1 is a schematic perspective view, with exterior portions thereof cut away for clarity, of an exemplary cushion according to the present invention.

The invention relates to cushioning assemblies in general, such as car or furniture seats, mattresses, cushions, backrests, and the like, and may take any number of a variety of shapes to conform to the particular use thereof. Two particular forms that the cushioning assembly according to the present invention may take are shown schematically in FIGS. 1 and 2. In FIG. 1, the cushioning assembly takes the form of a cushion 10. The cushion 10 contains three major components — a body member 12, formed of resilient deformable material such as foam rubber or the like, a plurality of substantially fluid-tight, fluid-filled cells, 14, and valve means 16 for selectively sealing off the cells 14 from one another so that no free flow of fluid therebetween is possible, or for allowing free communication between the cells 14 so that free flow of fluid therebetween may take place.

The cells 14 are preferably pre-filled with fluid under pressure (i.e. compressed air), and are so arranged that they take up all the space within the confines of the cushion 10 not taken up by the foam rubber of the body member 12. The cells 14 may be disposed in abutting engagement with each other, or may have a layer of foam or the like disposed therebetween. The cell walls 18 may be constructed of any suitable material that allows for a change in the volume of fluid held by the cells 14, such as rubber, various plastics, etc.

Figure 3:
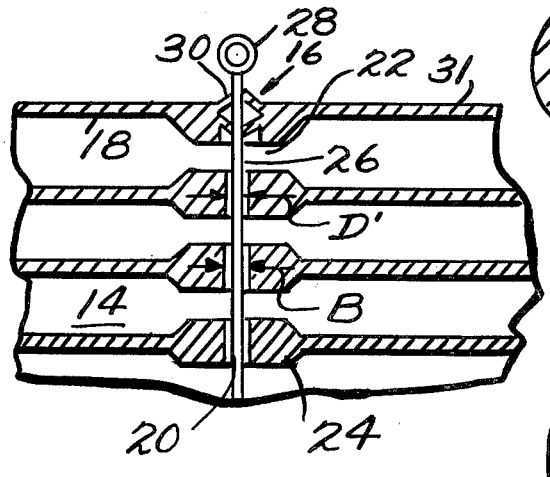
FIG. 3 is a detail schematic view of valve means according to the present invention cooperating with cell entrances, with the valve means in the open, free fluid communication, position.
Figure 4:
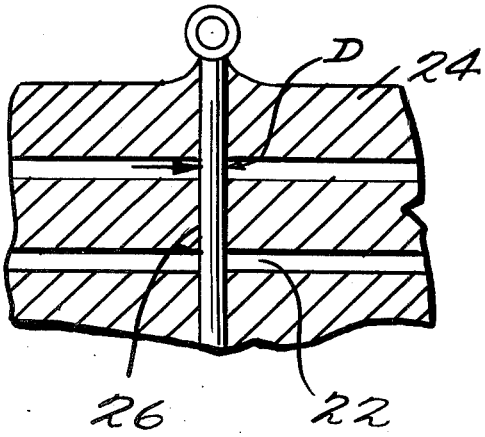
FIG. 4 is a view like FIG. 3 showing the valve means in the closed, no fluid communication, position thereof.

Communication between each of the cells 14 may be provided by a tube 20, connecting the entrances 22 to each of the cells 14 (see FIG. 3). The tube 20 generally has a substantially constant inside diameter $\beta$, (see FIGS. 3 and 4), and is generally fixed to resilient deformable material 24 forming the body member 12. Disposed generally concentrically within the tube 20 is an elongated cylindrical resilient valve member 26. The member 26 may be made out of any suitable resilient material, such as rubber, and may be solid or hollow depending upon the particular dimensions and materials used. The member 26 is arranged so that in its normal, contracted position thereof (see FIG. 4), it has an outside diameter D that is as great as (or even slightly greater than, if the member 26 were allowed to expand fully) the inside diameter $\beta$ of the tube 20. In this position, the entrances 22 to all of the cells 14 are closed off by the member 26, and fluid communication therebetween is prevented. In this position, then, whatever the fluid pressure is within a cell 14 at the time the member 26 assumes the FIG. 4 position will be maintained in that cell. When the member 26 is elongated, such as by pulling on the handle 28 affixed to one end thereof, the outside surface of the member 26 moves away from the entrances 22, and the outside diameter of the member 26 becomes D′, which is less than D and less than the inside diameter $\beta$ of the tube 20. In this position (FIG. 3), free fluid communication between all the cells 14 is provided.

Preferably, there is provided a resilient seal means 30, such as a disc of rubber or the like, sealing the outside of the valve member 26 and handle 28 therefor to the outside covering of the cushion 10 (a fabric covering 31 or the like may be provided over the foam 24 of body member 12). This allows movement of the handle 28 and member 26 connected thereto relative to the rest of the cushion 10 without fluid leakage from the body member 12 to the environment, or vice-versa. The end of the member 26 not connected to handle 28 may be anchored to any suitable structure within or associated with the cushion 10, such as an interior portion, or support plate, of the fabric covering 31 of cushion 10, or it may be connected to another handle, so that handles at both ends of the cushion are pulled at the same time when elongation of the member 26 is desired.

Figure 2:
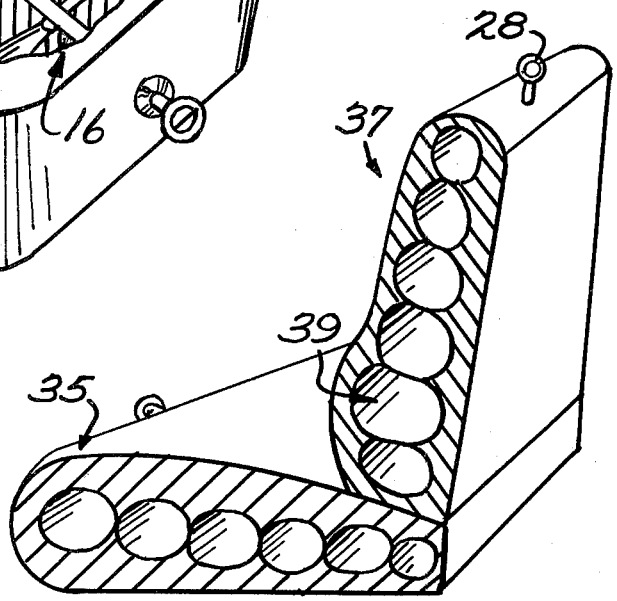
FIG. 2 is a side cross-sectional view of an exemplary car seat according to the present invention.

While the invention has been described above as in the form of a cushion, it will be apparent that it may assume a number of other forms. For instance, it may take the form of a chair cushion, a couch seat and/or backrest, a mattress, or as shown in FIG. 2, a car seat, including seat portion 35 and back portion 37. When used as a car seat, or other stationary cushioning assembly, the member 26 may be readily anchored to some structural component of the device at one end thereof.

An advantageous result according to the present invention is that a cushion is provided that can be deformed to conform to any posture, or to provide support to any part of one's body, yet no complicated compressed air source or valves are required. For instance, if one would like support for the arch of one's back, the handle 28 is pulled so that the valve member 26 assumes the position shown in FIG. 3, the cushion 10 or backrest 37 is worked around until a bulge (see 39 in FIG. 2) is formed at the portion thereof at which the arch of one's back will be disposed in use, and the handle 28 is released, allowing the member 26 to assume the position of FIG. 4. When the valve member 26 was open, free fluid flow between cells 14 was possible, so that in response to manual working of the cushion 10 or backrest 37 air could be forced out of some cells 14 to which physical pressure was applied, and into other cells 14 to which no physical pressure was applied, thus creating a bulge 39. When the valve member 26 was then closed (FIG. 4), further communication between the cells 14 was not possible, and the cushion 10 or backrest 37 was locked in place with a bulge (bulge 39) applying pressure to the arch of the user's back.

While it is preferred that the cushioning assembly according to the present invention be provided as a self-contained unit, an exterior valve 41 or the like may be provided to allow the addition of air or the bleeding of fluid from the cushion 10 or the like, to compensate for pressure changes due to atmospheric temperature changes, minor leakage, etc., or to adapt the device to a particular environment in which the device is to be used, etc.

While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A cushioning assembly comprising a. a body member formed of resilient material, b. a plurality of individual substantially fluid-tight, fluid-filled cells disposed within said body, and c. means for selectively sealing off said cells from one another so that no free flow of fluid therebetween is possible, or for providing free communication between said cells so that free flow of fluid therebetween takes place, said selective sealing means comprising a common passageway communicating with each of said individual cells, each of said cells having an entrance into said passageway, and an elastic elongated three-dimensional body located within and extending along said passageway, said body having a first, expanded, position thereof filling the passageway so that the entrances to a plurality of said cells are blocked off thereby, and a second, contracted, position thereof not completely filling the passageway so that free communication is provided between said cells through said passageway.

2. An assembly as recited in claim 1 wherein said elastic elongated body for selectively blocking or opening said cell entrances comprises an elastic cylindrical member having a first normal contracted position thereof wherein the outside diameter thereof is large enough to close off all of said individual cell entrances, said member having an outside diameter substantially the same as the inside diameter of said passageway, and said member having a second elongated position thereof wherein the outside diameter thereof is less than the inside diameter of said passageway whereby said entrances are open and free communication of fluid therebetween is allowed.

3. An assembly as recited in claim 2 wherein said elastic cylindrical member is tubular.

4. An assembly as recited in claim 1 further comprising means for allowing the addition of fluid under pressure to said plurality of cells.

5. An assembly as recited in claim 1 wherein said body member is a first body member, and further comprising a second body member formed of resilient material having a second plurality of fluid-filled cells therein and a second means for selectively sealing off said second plurality of cells from one another and for allowing free communication therebetween, said first body member being formed as a seat member, and said second body member as a backrest member.

* * * * *